United States Patent [19]

Bauer et al.

[11] 4,266,116

[45] May 5, 1981

[54] ELECTRODE-TYPE STEAM GENERATING DEVICE FOR GENERATING SUPERHEATED STEAM

[75] Inventors: Daniel Bauer, Le Raincy; Jean-Paul Beck, Paris; Claude Boiteau, Verneuil; Didier Garoche, Levallois, all of France

[73] Assignee: L'Oreal, Paris, France

[21] Appl. No.: 877,725

[22] Filed: Feb. 14, 1978

[30] Foreign Application Priority Data

Feb. 16, 1977 [LU] Luxembourg ..... 76777

[51] Int. Cl.[3] ..... H05B 3/60; F22B 1/30; B05B 1/24

[52] U.S. Cl. ..... 219/274; 132/9; 219/222; 219/275; 219/291; 219/292; 239/133; 239/136

[58] Field of Search ..... 219/284-295, 219/271-276, 222; 132/112, 7, 9, 11; 239/133, 136

[56] References Cited

U.S. PATENT DOCUMENTS

| | | | |
|---|---|---|---|
| 1,604,408 | 10/1926 | Graetzer | 219/291 |
| 2,140,516 | 12/1938 | Cowan | 219/274 |
| 2,400,618 | 5/1946 | Wicks | 219/291 |
| 2,519,515 | 8/1950 | Turner | 219/292 X |
| 2,588,314 | 3/1952 | Wicks | 219/284 X |
| 2,835,781 | 5/1958 | Bashuk | 219/284 X |
| 3,781,519 | 12/1973 | Martin et al. | 219/273 |
| 3,814,898 | 6/1974 | Levine | 132/112 X |
| 4,166,473 | 9/1979 | Bauer et al. | 219/271 |

FOREIGN PATENT DOCUMENTS

| | | | |
|---|---|---|---|
| 518500 | 1/1921 | France | 219/285 |
| 1309395 | 10/1962 | France | 219/274 |
| 367761 | 8/1930 | United Kingdom | 219/284 |
| 386491 | 1/1933 | United Kingdom | 219/291 |
| 448966 | 6/1936 | United Kingdom | 219/291 |

*Primary Examiner*—A. Bartis
*Attorney, Agent, or Firm*—Brisebois & Kruger

[57] ABSTRACT

A superheated vapor generator including a porous material substantially filling an annular space between two concentric spaced apart tubular inner and outer electrodes connected across a power source. A pump is provided to pump a predetermined quantity of liquid into the porous material to temporarily complete the circuit through the electrodes and generate superheated vapor or steam. Since the liquid itself completes the circuit, no switches or controls are required. Labyrinthe passages between the pump and the inlet to the annular space and between the interior surface of the inner electrode and a tubular steam discharge outlet prevents dangerous current leakage and assure generation of superheated vapor. An electrically grounded porous metal plug in the vapor outlet minimizes electrical shock hazards. The vapor generator is held in the hand and can be used for setting or treating human hair.

4 Claims, 8 Drawing Figures

Fig. 5
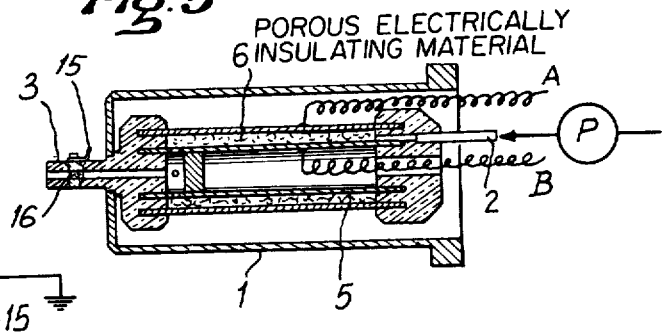
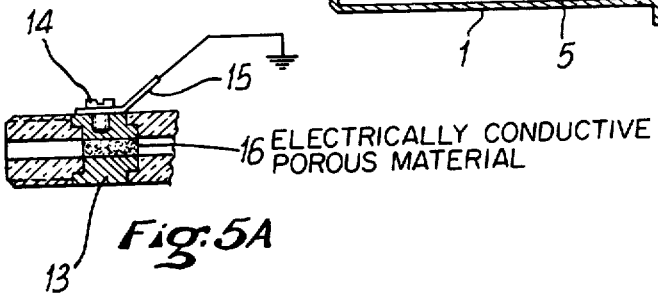
Fig. 5A
Fig. 6
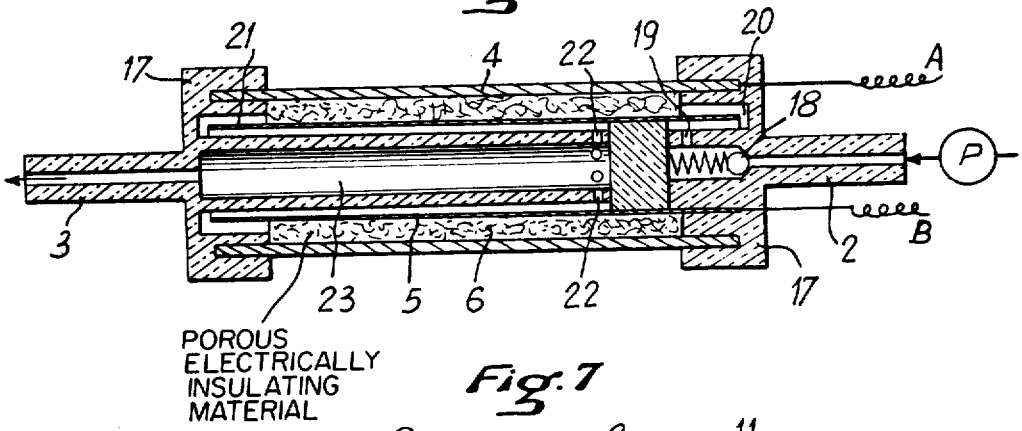
Fig. 7
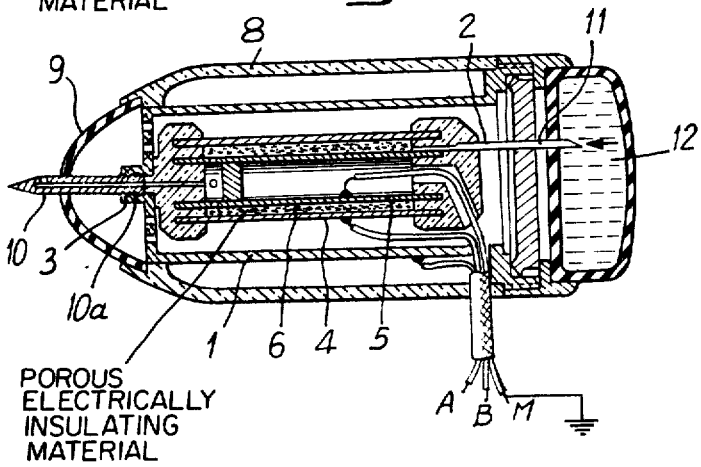

ELECTRODE-TYPE STEAM GENERATING DEVICE FOR GENERATING SUPERHEATED STEAM

The present invention relates to a device for generating superheated steam or vapor beginning with a liquid source.

In numerous applications it is desirable to make use of superheated steam, produced instantaneously in a predetermined quantity. As a specific application, one can cite, for example, apparatus designed to treat hair with superheated steam, especially for hair setting; such as the apparatus described in U.S. Patent application Ser. No. 584,980, filed June 9, 1975, now U.S. Pat. No. 4,166,473 granted Sept. 4, 1979 and assigned to the same assignee as this application.

In that patent application, there are described several embodiments of such apparatus comprising various types of heating elements which can produce superheated steam instantaneously.

In addition, devices for the production of vapor already exist, especially in apparatus for removing wrinkles from garments or in ambient air humidifiers in which vapor is obtained from electrodes permanently immersed in the reservoir containing the liquid. Such devices however do not assure a precisely controlled instantaneous supply of a predetermined quantity of vapor, and in particular do not supply superheated steam.

By superheated steam, the present invention means vapor exiting from a device at atmospheric pressure in a superheated state at a temperature greater than 105° C.

The present invention relates to a new device for generating superheated steam in which the liquid to be vaporized itself acts as the element which closes the electrical circuit and as the regulating element, since it is the more or less great quantity of liquid introduced which determines the magnitude of the current and the instantly necessary electrical power. Thus conservation of energy is assured, since although the device can be connected permanently to the power supply, it only uses energy at a time when the quantity of liquid to be vaporized is introduced, which in particular permits obtaining significant instantaneous power for the small volume of the device.

The object of the present invention is the new industrial product which constitutes a device for generating superheated steam from a liquid source, characterized by the fact that it comprises, in an envelope, a pair of cylindrical or concentric prismatic electrodes connected to the terminals of an electrical energy source. There is a porous material between the electrodes, the porous material being electrically insulating, having a small thermal inertia, and being chemically inert with respect to the liquid to be vaporized. There is also a pump means to feed into the envelope a predetermined quantity of liquid to be vaporized in the porous material, and a means for the vapor produced to exit from the envelope.

The predetermined quantity of liquid to be vaporized, and thereby the predetermined quantity of vapor produced, can be obtained notably by injecting regulated quantities of liquid into the envelope, by pumping from a liquid source, the pump means preferably exerting on the liquid a pressure for example, greater than 0.5 bars (of relative pressure).

As porous material having the characteristics stated below, one can mention, for example, various mineral or natural organic or fibrous synthetic materials, granular materials, sintered materials, such as, for example, asbestos, P.T.F.E., glass wood, cellulose fibers, felt, or packing of wool or silica, without this list being in any way limiting.

If one uses a fibrous material, it is desirable that the gauge of the fibers be less than 500μ. In addition, it is equally desirable that in the porous material inserted in the device, the ratio between the volume of air space and the total volume of porous material be less than or equal to 50%.

The liquid used will depend on the application envisioned. It is suitable however that the conductivity of the liquid be less than or equal to $3+10^{-5}\text{Ohm}^{-1}\text{cm}^{-1}$. Several vaporisable liquids can be cited as examples in the device according to the invention, namely, distilled water, demineralized water, and water-alcohol mixtures, without this list likewise being limiting.

In one particular embodiment of the invention, the device comprises, in addition, an electrical resistance, mounted in series with the above-mentioned electrodes at the terminals of the electrical energy source.

The distance between these electrodes, that is, the size of the space into which the porous material is introduced is naturally a function of the liquid, of the voltage of the electric current which is used, of the surface of the electrodes, and of the power desired to be drawn from the power supply.

Thus for example for a practically useful device with a length of 4.5 cm supplied with 220 V and having a input power between about 100 watts and 400 watts, the distance between the electrodes is between 0.9 mm and 4 mm.

One must likewise choose the length of the electrodes, in such a way that the quantity of liquid introduced is vaporized in the porous material between the electrodes even if it produces some condensation between the electrodes, the material being such that one would obtain a good distribution of the liquid in the material, a good homogenity of the vapor, and over pressure which permits obtaining superheated steam as well as turbulence in the midst of the mass of material.

According to one advantageous characteristic of the invention and to increase electrical safety, in particular if there is a break in one of the supply wires, one increases the circulation path of the liquid to be vaporized in the device and of the vapor produced, by delimiting, inside the device, a passage conduit of reduced section and in the form of a labyrinthe.

As a variation, it is possible to provide in the vapor exit means an electrically conducting means, particularly electrically grounded metal.

As particular applications of the device according to the invention one can mention the various apparatus described in U.S. patent application Ser. No. 584,980, such apparatus then being characterized by the fact that they can contain, as vaporization elements, the device of the invention, and a pumping mechanism for drawing out of a reservoir a given quantity of a liquid to be vaporized, and an injector or a perforated tubular body for bringing the superheated steam produced in the vaporizing element in contact with the hair.

Numerous other applications of the device according to the invention can be envisioned.

In particular, one can mention the embodiment of pressing irons, without a metal face-plate, possibly without an electrical resistance heater, and of small thermal energy. Such an iron is very lightweight, lends itself to domestic use and is very practical for pressing delicate fabrics.

One can likewise envision as an application, use in conjunction with carburetors of vehicles with internal combustion engines, or oil burners, in which it is desirable to introduce water vapor in small quantities in the air used for combustion, with a very short response time.

Other advantages and features of the invention will become apparent from consideration of the following description of several particular embodiments of the device according to the invention, with reference to the accompanying drawings.

BRIEF DESCRIPTION OF DRAWINGS

FIG. 5 shows a variation of the device of FIG. 3;

FIG. 5A is an enlarged view of the steam outlet of FIG. 5;

FIG. 6 shows another variation of the device of FIG. 3; and,

FIG. 7 shows a variation of the apparatus of FIG. 4.

Figure 1:
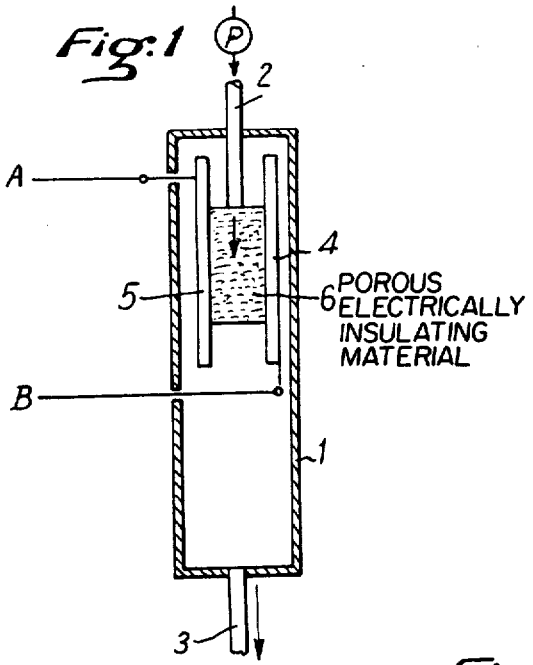
FIG. 1 is a schematic view of a first embodiment of a device according to the invention.

The arrangement represented in FIG. 1 includes an envelope or housing 1 having an inlet for liquids, shown schematically at 2, from a pump means P, and an outlet for vapor shown schematically at 3.

At the interior of envelope 1, and connected to terminals A, B of a source of electrical energy, are two electrodes 4 and 5, formed for example, of non-oxydizable steel or of carbon between which is positioned a mass of electrically insulating porous material 6 presenting a small thermal inertia, and chemically inert with respect to the liquid to be vaporized. When the liquid is distilled water or demineralized water, one can for example use glass wool, or other high temperature resistant electrically insulating wool material.

Figure 2:
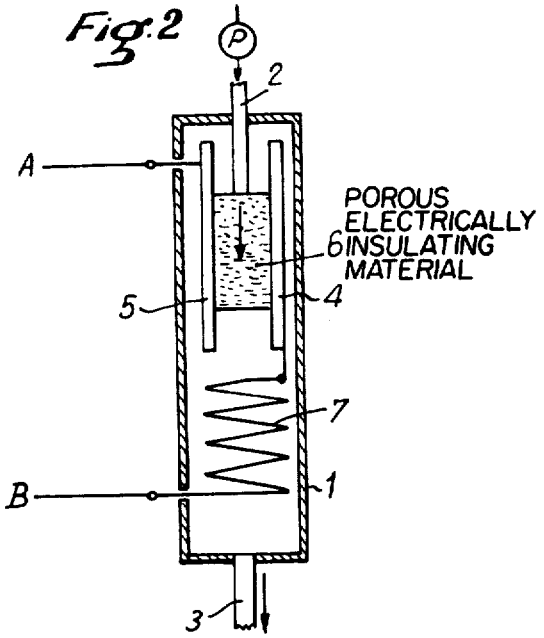
FIG. 2 is a schematic view of a second embodiment of a device according to the invention.

The embodiment of FIG. 2 is uniquely distinguished from the embodiment of FIG. 1 by the presence of an electrical resistor 7 connected in series with the electrodes 4 and 5, connected between the terminals A, B of the source of electrical energy.

When a quantity of liquid is introduced through the tube 2, the liquid enters the mass of porous material 6 between the electrodes 4 and 5, and because the electrodes are fed electrical energy, the product is heated by Joule effect to assure the vaporization of the water and the production of vapor which escapes from the envelope 1 through the tubular outlet 3 to be used. The porous material being electrically insulating, it is evident that the liquid to be vaporized operates as the closure element of the electric circuit, that is to say it is the introduction of the liquid which completes the circuit between the electrodes and causes the passing of current, and its disappearance which causes the cut-off of current. The liquid also operates as the heating element, the calories being produced by Joule effect also in the interior of the liquid contained in the pores of material 6. It is also the liquid which serves as the regulating element, to the extent that it is the more or less large quantity of liquid introduced which determines the necessary electrical power instantaneously. It should be understood that the apparatus only uses a very small quantity of energy, uniquely during the short time when vaporization takes place, the envelope 1 of the device not having a tendency to itself heat, which permits its holding in the hand without risk of excessive heating by the device according to the invention.

Figure 3:
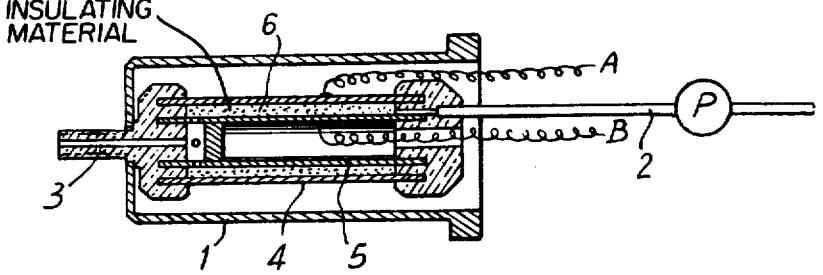
FIG. 3 is a view in section showing a preferred form of the embodiment shown schematically in FIG. 1.

FIG. 3 shows a device according to the invention which operates according to the schematic principle of FIG. 1. The device contains two concentric electrodes 4 and 5, formed for example of non-oxydizable steel such as stainless steel or other highly oxidation resisting metal, and contains between the electrodes, porous material 6 of glass wool.

In one particular example of this embodiment, the electrodes used have a length of 3 cm, a radial spacing from one to the other of 3 mm, the surface of the electrodes being 6 $cm^2$. One can also connect in series with the electrodes a heating resistance which can for example be 60 Ohms. With an alternating supply voltage of 220 volts and a supply current intensity of 0.5 amps, one obtains upon injection of 0.2 cc of distilled water, an instantaneous power of 110 watts and the production of superheated steam.

Figure 4:
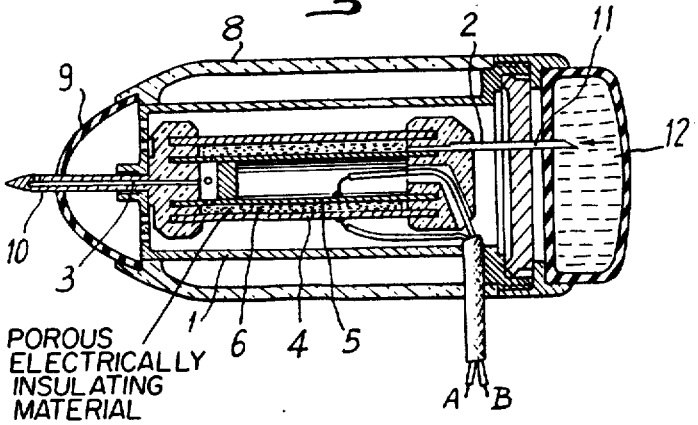
FIG. 4 shows an embodiment of a vapor injection apparatus including the device of FIG. 3.

FIG. 4 shows an application of the device according to FIG. 3 in the environment of a vapor injector apparatus of the type described in U.S. Pat. No. 4,166,473. This apparatus comprises an external envelope 8 having at its forward part an element in the form of a dome, preferrably in the form of a supple rubber element 9 through the interior of which passes a hollow injection needle 10.

The apparatus comprises as the vaporization element, the device according to the invention shown at FIG. 3. The injection needle 10 is connected at the vapor outlet 3, the liquid inlet 2 being formed by the intermediary of a hollow needle 11 pushed into a detachable supple reservoir 12 positioned at the rear of the apparatus. To cause operation of the device it is sufficient to press the rubber dome 12 to vaporize a corresponding quantity of liquid, the vapor escaping through the injection needle 10. It must however be understood that FIG. 4 only represents one form of possible application of the device according to the invention, and such device can be used as an element of vaporization in any of the apparatus described in the U.S. Pat. No. 4,166,473, and also as a vaporizer device in numerous other applications some of which have been enumerated in this application.

The device shown at FIG. 5 and FIG. 5A is different from the device shown at FIG. 3 by the presence in the tubular vapor outlet 3, of an electrically conducting bushing 13 notably of metal, fixed in the vapor outlet tube. This bushing 13 is connected to ground by an electrically conducting line 15 connected to the bushing with screw 14. In addition, an electrically conductive plug or packing 16, preferrably sintered material, is positioned in the outlet conduit for vapor from the tube 3, within the bushing. There is thus attained electric safety which prevents the user from receiving a shock while handling the apparatus if one of the electrical supply wires becomes broken.

A variation of the embodiment of the device according to the invention which equally provides increased electrical safety is shown in FIG. 6.

In FIG. 6 the device comprises, as do those of FIGS. 3 and 5, an inlet feed tube 2 for the liquid to be vaporized, a pump means P, a tubular vapor outlet 3, and two concentric electrodes 4 and 5 between which is disposed a mass of porous electrically insulating material 6 having the characteristics previously explained. The external electrode 4 which one will notice from FIG. 6, serves as the external envelope, is mounted in end plates of electrically insulating material 17. The device comprises at the feed end for liquid to be vaporized, a valve 18 constituted of a ball returned by a spring and permitting the entry of liquid to be vaporized into the device when the liquid is fed by the pump means P with a pressure sufficient to move the ball against the action of the spring. The liquid then traverses one or plural orifices 19 and enters a conduit of small section in the form of a labyrinthe 20 and then flow to the mass of porous material 6 from which it exits by another labyrinthe-shaped conduit 21 and passes through one or plural orifices 22 into an elongated chamber 23 from which it passes to the tubular outlet 3. It should be understood that such a labyrinthine path inside of the apparatus, augmented by the length of the outlet tube 3, gives to the liquid to be vaporized and to the steam produced in the apparatus, a path of great length and small section, which increases the electrical resistance due to the liquid in the apparatus and thus reduces to a very large degree the intensity of the shock which would be received by the user of the apparatus in the event of a break in one of the supply wires to the electrodes.

For the sake of example, one has constructed a device according to FIG. 6 having a length of 45 mm, the radius of the internal electrode being 4 mm, the radius of the external electrode being 6 mm. One obtains between the electrodes a space of 2 mm, and an electrode surface of 11 $cm^2$.

For a volume of distilled water of 1 cc contained in the porous material disposed between the electrodes, one obtains under a supply voltage of 220 volts and a current intensity of 1 amp, an instantaneous power of 220 watts and the production of superheated steam.

FIG. 7 shows a variation of the superheated vapor injector apparatus which is essentially the same as that shown in FIG. 4. The apparatus of FIG. 7 differs from that of FIG. 4 by the fact that the electrical supply conductor includes a ground engagement part comprising a wire mass M connected to the envelope 1 of the device and which is connected to ground.

The injection needle 10 which is used, is made of an electrically conducting material, in particular a metal or a plastic material charged with carbon, and is fixed to envelope 1 by a threaded metal sleeve 10*a*. One understands that therefore the injection needle itself is also grounded to improve the electrical safety.

In addition, while the invention has been described in combination with particular embodiments, it is well evident that the invention is not limited to the embodiments described and that one can make suitable modifications without departing from its scope and its spirit.

What is claimed is:

1. Steam generating apparatus for generating steam from a liquid comprising:

a first end member of electrically insulating material;

a second end member of electrically insulating material;

an inner tubular electrode extending between said end members;

an outer tubular electrode surrounding said inner electrode and extending between said end members so that there is an annular space beween the inside surface of the outer electrode and the outside surface of the inner electrode;

said annular space having an inlet adjacent one of said end members and an outlet adjacent the other of said end members;

means connecting said electrodes in series across a source of electrical energy;

a porous material substantially filling said annular space between the electrodes, said porous material being electrically insulating, having a small thermal inertia, and being chemically inert to the liquid to be vaporized, means for directing liquid to be vaporized into the inlet of said annular space;

means within said inner electrode for defining a vaporized fluid passage extending along and including an interior surface of said inner electrode, said passage communicating with the outlet of said annular space and extending along a substantial portion of the inner electrode in a direction from said outlet toward said inlet; and tubular outlet means communicating with said passage at a location remote from the outlet of the annular space for discharging vaporized liquid from the apparatus.

2. Apparatus according to claim 1 wherein said apparatus is designed and arranged so as to produce superheated steam at said tubular outlet, and said electrodes comprise non-oxydizable electrodes.

3. Apparatus according to claim 2 wherein said electrodes comprise stainless steel electrodes.

4. Apparatus according to claim 1 further comprising a casing surrounding said outer electrode.

* * * * *